United States Patent [19]

Coppersmith

[11] 3,938,714

[45] *Feb. 17, 1976

[54] POURING SPOUT DISPENSING SYSTEM

[75] Inventor: Morris Coppersmith, Wyncote, Pa.

[73] Assignee: Packaging Aids, Inc., Wyncote, Pa.

[ * ] Notice: The portion of the term of this patent subsequent to Aug. 27, 1991, has been disclaimed.

[22] Filed: Aug. 26, 1974

[21] Appl. No.: 500,755

Related U.S. Application Data

[63] Continuation-in-part of Ser. No. 260,860, June 8, 1972, Pat. No. 3,831,824.

[52] U.S. Cl. ..... 222/525; 222/541; 222/569

[51] Int. Cl.[2] ..... B67D 3/00

[58] Field of Search ..... 222/522, 524, 525, 526, 222/537, 527–529, 538, 539, 541, 566, 569, 570, 500

[56] References Cited

UNITED STATES PATENTS

| | | | |
|---|---|---|---|
| 2,205,082 | 6/1940 | Callaghan et al. | 222/525 |
| 2,574,105 | 11/1951 | Janczak | 222/538 |
| 2,617,561 | 11/1952 | Marek | 222/522 |
| 3,831,824 | 8/1974 | Coppersmith | 222/537 |

*Primary Examiner*—Robert B. Reeves
*Assistant Examiner*—H. Grant Skaggs
*Attorney, Agent, or Firm*—Paul Maleson; Morton J. Rosenberg

[57] ABSTRACT

An improved dispensing system for removing liquid or particulate material from within a container to some external environment. The improved dispensing system includes a container and a retractable spout member located within the container when not in use. The container forms an enclosure having a removable member integrally formed on a top wall of the container. The removable member may be displaced with respect to the top wall along a pre-weakened contour outline to form an opening in the enclosure. The spout member may be extracted from within the container through the opening to permit guidance in the pouring of matter from the container. The spout member is generally trough shaped in a substantially conical form and includes an extended tab member formed on a bottom surface thereof to provide predetermined angular relations between the spout member and the container extension direction to aid in removing the spout member through the opening of the container. Additionally, the spout member includes a channel section to releasably secure the spout member to the container when in position for use.

10 Claims, 6 Drawing Figures

FIG. 1
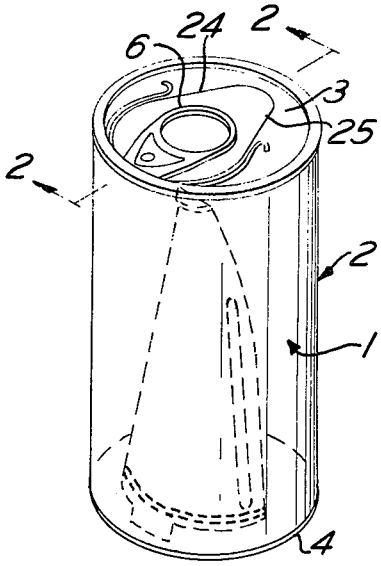
FIG. 2
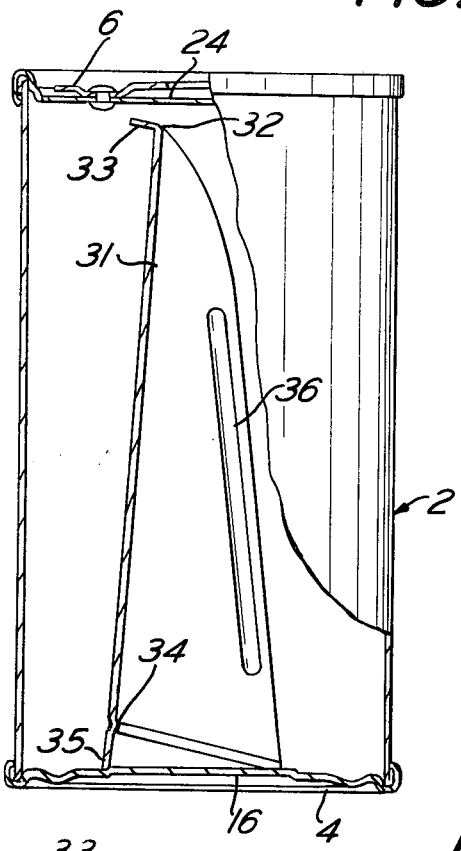
FIG. 4
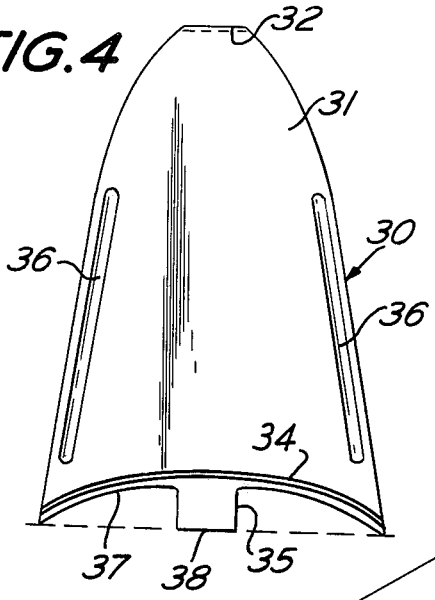
FIG. 6
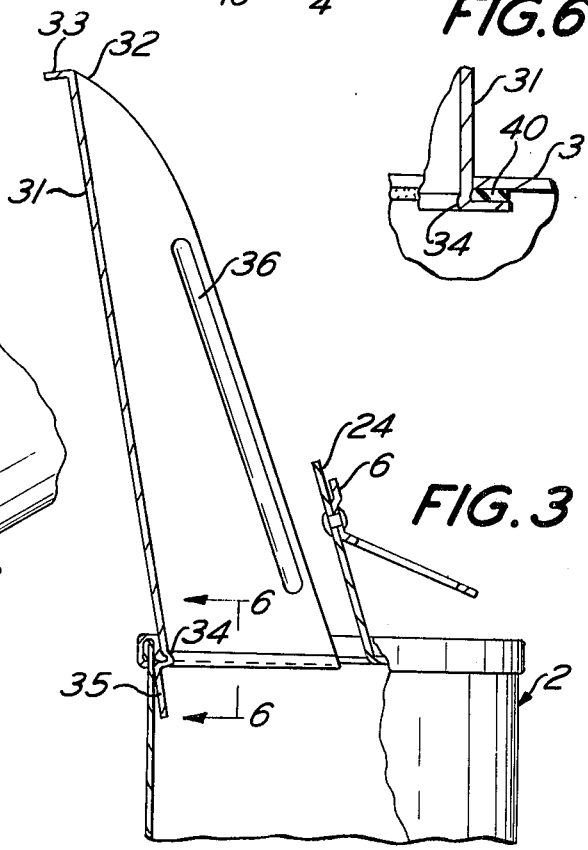
FIG. 3
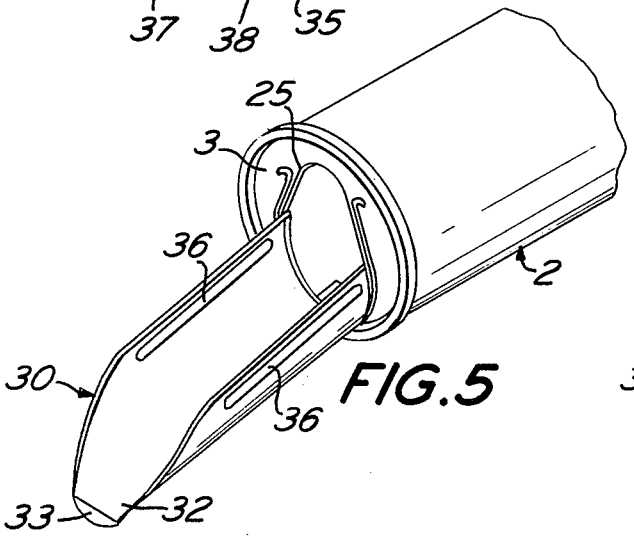
FIG. 5

POURING SPOUT DISPENSING SYSTEM

CROSS REFERENCE TO RELATED APPLICATIONS

This patent application is a continuation in part of patent application, Ser. No. 260,860, filed June 8, 1972 and to be issued as U.S. Pat. No. 3,831,824.

This patent application incorporates by reference Pat. No. 3,831,824 to be issued Aug. 27, 1974.

BACKGROUND OF THE INVENTION

1. Field of the Invention

This invention relates to the field of material transport. In particular this invention pertains to the field of dispensing systems. More in particular, this invention relates to the field of transferring and guiding material from within a container to some external environment. Still further, this invention pertains to the field of dispensing systems including a container and a retractable spout mechanism contained therein.

2. Prior Art

Dispensing systems for guiding the flow of material from an enclosure or container are well known in the art. One such type of dispensing system having improved properties is shown in my copending patent application, Ser. No. 260,860 filed June 8, 1972 and to be issued as Pat. No. 3,831,824 of which this is a continuation in part. In the improved dispensing system as is herein described, there is shown additional structure to maintain a spout member at a predetermined position with respect angular relations between the spout member and the container extension direction when the spout member is within the container or partially removed therefrom. This particular positional placement aids in removing the spout member from within the container when the improved dispensing system is put into use.

Additionally, the improved dispensing system of the instant application includes track members formed on a side wall of the spout to diminish the possibility of gouging the opening formed in a top wall of the container when the spout member is removably displaced. Thus, in some prior instances removal of the spout member from within the container has caused some gouging either in the wall of the spout member or of the container which may have detremental effects on the material being removed. Thus, with the addition of the track members there is provided a reduced possibility of leakage of the material in unwanted areas.

SUMMARY OF THE INVENTION

A dispensing system which includes a longitudinally extended container having opposing wall members displaced each from the other. At least one of the wall members has a removable section formed integral with the wall member in a plane substantially coincident with the wall member for forming an opening of predetermined contour when at least a portion of the removable section is displaced from the wall member. Additionally, the dispensing system includes a spout member which is located wholly within the container when the removable section is contiguous to the wall member throughout the predetermined contour. The spout member extends substantially between the opposing wall members when the spout member is located wholly within the container and is free floating within the container. The spout member is only partially removable from the container through the opening when the removable section is displaced from the wall member. A mechanism for releasably securing spout member to the container is included when the spout member is only partially removed from the container through the opening by gravity assist. The releasable securing mechanism forms a groove passing throughout a peripheral boundary of one end of the spout member for releasably capturing the wall section of the wall member opening contour.

BRIEF DESCRIPTION OF THE DRAWINGS:

FIG. 1 is a perspective view of the improved dispensing system showing the spout member in dotted lines within the container;

FIG. 2 is a sectional view, partially cut away showing the spout member within the container and taken along the section lines 2—2 of FIG. 1;

FIG. 3 is a side view of the improved dispensing system, partially cut away, showing the spout member partially removed from the container;

FIG. 4 is an elevational view of the spout member;

FIG. 5 is a perspective view of the improved dispensing system showing the spout member partially removed from the container and adapted for use; and FIG. 6 is a side view of an embodiment of the invention showing sealant between a flange portion of the spout member and the wall surface of the container.

DESCRIPTION OF THE PREFERRED EMBODIMENTS:

Referring now to FIGS. 1–6 there is shown improved dispensing system 1 to aid in dispensing and guiding the flow of liquid or other particulate matter from within a container to some external receptacle. As is shown in FIGS. 1–4, transport or improved dispensing system 1 includes spout element 30 which is generally trough shaped and is internally located with respect to the container before the contained matter is dispensed externally. As will be described in the following paragraphs, spout member 30 is retractable with respect to the interior of the container and is partially removable therefrom. Additionally, spout member 30 is formed in a predetermined manner to provide predetermined positional relation of member 30 when such is maintained wholly within the container and when it is partially removed from the container as is shown in FIG. 3. Removal of spout member 30 from the container may be accomplished through gravity assist as a direct result of tilting the container to permit material contained therein to flow out.

As is shown in FIG. 1, the container or enclosure is longitudinally extended in a direction defined by the height dimension of container side wall or lateral wall 2. The container further includes opposing wall members 3 and 4 defining an upper wall and lower container wall respectively. Upper wall member 3, as shown, illustrates the top surface member of the container and is displaced from the lower container member or wall 4 by lateral side wall 2. It will be seen in FIG. 2 that lower wall member 4 may include a container bottom recess portion 16 upon which spout member 30 may interface when spout member 30 is located wholly within the container. In structure, it is thus seen that upper container wall 3, lower container wall 4 and lateral side wall 2 form an internal chamber where liquid or particulate matter may be contained.

Upper wall or top surface member 3 includes a removable or partially removable tab member 6. When removed, tab member 6 provides for somewhat oblong or circular contour outline 25 as is clearly shown in FIG. 5. In general, removable section or tab member 6 is integrally formed with wall 3 and attached thereto throughout the pre-weakened contour outline 25. Tab member 6 is formed or otherwise rigidly attached to wall member 3 and provides a mechanism whereby an operator or user may grasp a section of pull tab 6 to remove or partially displace removable section 24 from container top wall member 3. In this manner, once tab member 6 is utilized to release removable section 24 from upper wall 3, an opening of predetermined contour is formed therethrough as defined by contour outline 25. This opening procedure exposes the contained material as well as spout member 30 to the external environment.

Thus in overall concept, the container portion of improved dispensing system 1 includes opposing wall members 3 and 4 which are displaced each from the other by container side wall 2. At least one of wall members 3 and 4 includes removable section 24 which is formed integral with wall member 3 or 4 in a plane substantially coincident with the wall member upon which it is formed. Removable section 24 forms an opening of predetermined contour outline 25 when at least a portion of section 24 is displaced from wall member 3 or 4. The container walls 2, 3 and 4 may be made or formed in one piece construction or separately in a number of standard procedures well known in the art and not important to the inventive concept as herein described. Further, the container elements may be constructed of a number of divergently composed materials such as plastic, aluminum, stainless steel, or other metals. The only restriction on container material as pertaining to the inventive concept being that the container element material used does not affect the purposes of the contained matter.

In general, it is therefore seen that spout member 30 is located and positioned internal to the container when removable section 24 is contiguously attached to upper container wall 3. When section 24 is partially displaced or removed entirely from top wall 3, spout member 30 is then partially removable through an opening provided by the displacement of section 24. In normal operation, and as will be seen in following paragraphs, the container is then tilted and spout member 30 passes through the described opening for purposes of passing the material contained within the enclosure or container to an external environment.

Spout member 30, as is shown in FIGS. 1 and 2 extends in a generally longitudinal direction having a longitudinal dimension substantially equal to but slightly less than the longitudinal displacement distance between opposing container walls 3 and 4. Spout upper surface or first end 32 remains substantially adjacent to an internal surface of upper wall member 3 when spout member 30 is located internal to the container. Additionally, as is clearly seen in FIGS. 2 and 4, spout member 30 includes lower surface 37 having tab member 35 secured thereto. Tab member 35 extends from lower surface 37 in generally a longitudinal direction and is used for positioning restraining spout member 30 at a predetermined location with respect to the container extension when member is located wholly within the container. As is seen in FIG. 4, lower surface 37 is generally formed in a predetermined contour which is curvilinear in nature and forms a cut-out section between opposing transverse ends of member 30. As is discernible in FIG. 2, spout member 30 thus rests on bottom recess 16 in comewhat of a tripod nature between the opposing transverse ends of member 30 and a lower surface 38 of tab member 35.

The length of tab member 35 is adapted to maintain a spout side wall 31 extension within the angular range of 5°–15° when taken with respect to the container extension as is shown in FIG. 2. It has been found that when tab member 35 is provided in improved dispensing system 1, that spout member 30 is maintained in a more vertical manner when taken with respect to the container extension than when no tab member 35 is provided. Thus, it has been found that with the addition of tab member 35, there is substantially less jamming when container is tilted and spout member 30 passes through contour outline 25 to dispense the material contained within the enclosure. It has been found through experimentation, by varying the length of tab member 35, that an optimized angular relation between the extension of spout side wall 31 and the longitudinal direction of container 2 is approximately 5°–15° and has a prefered angular relation approximating 10°.

In the event or particularly dense material being contained within the enclosure or for some other constrainment reason, extension tab 33 formed on side wall 31 near upper surface 32 is provided. Thus, where some difficulty may be found in passing spout member 30 through contour outline 25 by gravity assist, a user or operator may easily pull spout 30 through the opening formed when section 24 is displaced from upper wall 3. As is seen, tab member 33 extends outwardly from side wall 31 and may be formed in one piece construction therewith or secured thereto by a number of well known techniques in the art. It will noted that tab member 35 acting in conjunction with the opposing ends of spout member 30 maintains the positional relation of member 30 in a manner such that tab 33 may be easily grasped when section 24 is removed.

As seen in FIGS. 2 and 3 longitudinally directed side wall 31 of spout member 30 is generally formed in one piece construction and includes a groove or channel section 34 passing throughout a peripheral boundary of one end of spout member 30 for releasably capturing a wall section of wall member 3 throughout a portion of contour outline 25 when spout member 30 is partially removed from the container. As is seen in FIG. 3, a portion of upper wall 3 is thus releasably insertable within channel 34 to aid in maintaining securement of spout member 30 partially within the container when improved dispensing system 1 is oriented in a downward direction to release material contained therein. Groove or channel 34 passes in a substantially horizontal direction defining a plane which is substantially normal to the longitudinal extension of side wall 31 of spout member 30. Thus, in overall concept, groove member 34 provides a means for releasably securing spout member 30 to the container when spout member 30 is only partially removed from the container through the opening defined by contour outline 25. As is seen in FIG. 3, when spout member 30 is removed partially from the interior of the container and is in position for dispensing use, the extension of side wall 31 with respect to the longitudinal extension of the container approximates an angle of 10° and may be within the range of 5°–15°. As has been described, this angular relation is generally established by the length of tab member 35 taken with respect to the opposing transverse ends of side wall 31.

Spout member 30 further includes track elements 36 generally formed on a side wall 31 of member 30. Track elements 36 extend outwardly from side wall 31 and are directed substantially in the longitudinal direction as is shown in FIGS. 4 and 6. Ridge or bead elements 36 extend from side wall 31 in order to guide spout member 30 when it is being partially removed from the container. In previous systems, where no bead members 36 have been incorporated on side wall 31 there was a tendency to gouge the container upper wall 3 when member 30 was being displaced from the interior of the enclosure. It will be noted that the ridge members 36 pass through only a portion of the longitudinal extension of side wall 31 in a manner such that when spout 30 is extended form the container, that ridge or bead members 36 are not in contact with upper wall 3 along contour outline 25. Bead members 36 may be formed in one piece construction with side wall 31 of member 30 or otherwise secured thereto.

In an embodiment of the invention as is shown in FIG. 6 there is included sealant 40 which is adhesively secured to a flange of spout member 30 at a lower surface thereof. Sealant 40 is formed on a lower flange surface of spout member 30 and is formed between a lower surface of wall member 3 and the flange as is shown. Sealant 40 is adhesively secured to the flange of spout member 30 and may be formed of an elastomer which may in general be a silicon product well known in the art to prevent leakage of material within the container to an external environment when spout member 30 is partially removed as shown in FIG. 3. One such type of sealant is a polychloroprene material which is produced under the tradename Neoprene by DuPont Corporation. Thus when such material is to be used as a sealant 40, spout member 30 may be dipped in the sealant material and adhesively secures itself to the lower flange portion of member 30 for purposes of sealing when member 30 is partially removed from the container.

In this manner, there has been herein shown and described an improved dispensing system 1 which includes a retractable spout member 30 positioned within an enclosure or container. The improved dispensing system 1 as herein described provides for a simple, efficient and time saving apparatus whereby material may be dispensed. It will be understood that various changes and modifications may be made from the foregoing without departing from the spirit and the scope of the appended claims.

What is claimed is:

1. A dispensing system comprising:

a. a longitudinally extended container having opposing wall members displaced each from the other, at least one of said wall members having a removeable section formed integral with said wall member in a plane substantially coincident with said wall member for forming an opening of predetermined contour when at least a portion of said removeable section is displaced from said wall member;

b. a spout member located wholly within said container when said removeable section is contiguous to said wall member throughout said predetermined contour, said spout member extending substantially between said opposing wall members when said spout member is located wholly within said container and free floating within said container, said spout member being only partially removeable from said container through said opening when said removeable section is displaced from said wall member; and, c. means for releaseably securing said spout member to said container when said spout member is only partially removed from said container through said opening by gravity assist, said releaseable securing means forming a groove passing throughout a peripheral boundary of one end of said spout member for releaseably capturing a wall section of said wall member opening contour.

2. The dispensing system as recited in claim 1 where said spout member includes a tab member secured to a lower surface of said spout member and extending therefrom for positionally restraining said spout member at a predetermined location with respect to said container extension when said spout member is located wholly within said container.

3. The dispensing system as recited in claim 2 where said spout member lower surface includes a predetermined contour, said contour being curvilinear and forming a cut-out section between opposing transverse ends of said spout member.

4. The dispensing system as recited in claim 3 where said tab member extends from a central portion of said lower surface of said spout member and forms a coincident plane with said opposing transverse ends and a lower surface of said tab member when said spout member is located within said container.

5. The dispensing system as recited in claim 2 where said tab member is adapted in length to a predetermined dimension in order to maintain a side wall extension of said spout member within the angular range of 5°–15° with respect to said container extension when said spout member is located within said container.

6. The dispensing system as recited in claim 5 where said angular relation between said spout member side wall and said container extension approximates 10°.

7. The dispensing system as recited in claim 1 where said spout member includes track means formed on a side wall of said spout member, said track means extending outwardly from said side wall and being directed in substantially said longitudinal direction.

8. The dispensing system as recited in claim 7 where said track means includes a pair of ridge members extending from said side wall for guiding said spout member when being partially removed from said container.

9. The dispensing system as recited in claim 8 where said ridge members pass through only a portion of said extension of said spout members.

10. The dispensing system as recited in claim 1 where said releaseable securing means includes sealant means formed between a lower surface of said spout member and at least a portion of a lower surface of said wall member containing said opening for preventing leakage of material within said container where said spout member is partially removed.

* * * * *